US006349533B2

(12) United States Patent
Camozzi

(10) Patent No.: US 6,349,533 B2
(45) Date of Patent: Feb. 26, 2002

(54) UNIT FOR COMPACTING A BUNDLE OF TEXILE FIBRES DRAWN IN A SPINNING MACHINE

(75) Inventor: Attilio Camozzi, Brescia (IT)

(73) Assignee: Marzoli S.p.A., Brescia (IT)

( * ) Notice: Subject to any disclaimer, the term of this patent is extended or adjusted under 35 U.S.C. 154(b) by 0 days.

(21) Appl. No.: 09/884,078

(22) Filed: Jun. 20, 2001

(30) Foreign Application Priority Data

Jun. 21, 2000 (IT) ..... TO20A0605

(51) Int. Cl.[7] ..... D01H 13/04

(52) U.S. Cl. ..... 57/315; 19/150; 19/246; 19/252

(58) Field of Search ..... 190/150, 236–250, 190/252, 263, 286, 287, 288, 304–308; 57/264, 304, 315, 328, 333

(56) References Cited

U.S. PATENT DOCUMENTS 4,953,349 A * 9/1990 Fehrer ..... 57/315
6,108,873 A * 8/2000 Barauke ..... 19/246
6,263,656 B1 * 7/2001 Barauke ..... 57/315

OTHER PUBLICATIONS

Haver and Boeker's Catalog, "Stainless Steel Fine Mesh Woven Wire Cloth".

* cited by examiner

*Primary Examiner*—John J. Calvert
*Assistant Examiner*—Gary L. Welch
(74) *Attorney, Agent, or Firm*—Sughrue Mion, PLLC

(57) ABSTRACT

A fixed tube of circular cross-section, which is common to several spinning stations disposed side by side, is connected to a suction source and has, in each station, a suction slot arranged on the path of a bundle of fibres to be compacted and along its direction of advance. A cylindrical sleeve is freely rotatable on the tube and has a perforated portion which extends around a corresponding slot. The sleeve is rotated about the fixed tube by a pressure roller which presses the bundle of fibres against the perforated portion of the sleeve. The sleeve cooperates with an axially stationary retaining element which is separate from the tube and is arranged to limit the axial movements of the sleeve along the tube.

22 Claims, 3 Drawing Sheets

A
1
2
3
4
5
6
7
8
9
9a
9b
10
11
12
15
16
17
18
19
20
21
S
X1
X2

UNIT FOR COMPACTING A BUNDLE OF TEXILE FIBRES DRAWN IN A SPINNING MACHINE

BACKGROUND OF THE INVENTION

The present invention relates to a compacting unit for compacting a bundle of textile fibres drawn in a spinning machine.

The field of application of the present invention is that of spinning machines provided with a plurality of adjacent spinning stations in each of which there is a drawing unit associated with a compacting unit for treating a bundle of textile fibres or roving, to be transformed into a twisted yarn.

A drawing unit usually comprises three pairs of members which draw the roving along at increasing linear velocities in order to attenuate it gradually. The roving output by the drawing unit then goes to a compacting unit, disposed downstream of the drawing unit, before being sent for twisting. The compacting unit is served by a fixed tube of circular cross-section which is common to several spinning stations disposed side by side and is connected to a suction source; in each station, this tube has a narrow suction slot arranged on the path of the roving and along its direction of advance.

In each spinning station, a filtering element in the form of a cylindrical sleeve having a perforated central portion which covers the corresponding slot with a wide margin, is rotated about the fixed tube by a pressure roller of elastomeric material which presses the roving against the filtering sleeve.

An example of this known technique is described in co-pending U.S. patent application No. 716,458 which is incorporated herein by reference.

The outer surface of the fixed tube is machined to form projections and cylindrical recesses which house locating rings that serve to keep the filtering sleeves correctly positioned axially along the fixed tube so that the perforated central portions of the sleeves are centred on the respective suction slots.

SUMMARY OF THE INVENTION

An object of the present invention is to provide a compacting unit of simple and inexpensive construction which, in particular, eliminates the costs connected with the machining of the tube in order to make it suitable for housing the above-mentioned locating rings.

This and other objects and advantages which will be understood further from the following description are achieved, according to the present invention, by a compacting unit having the characteristics defined in Claim 1. Preferred embodiments of the invention are defined in the dependent claims.

BRIEF DESCRIPTION OF THE DRAWINGS

The characteristics and the advantages of the invention will become clear from the detailed description of some embodiments thereof, given with reference to the appended drawings provided by way of non-limiting example, in which.

DETAILED DESCRIPTION OF THE INVENTION

Figures 1, 2:
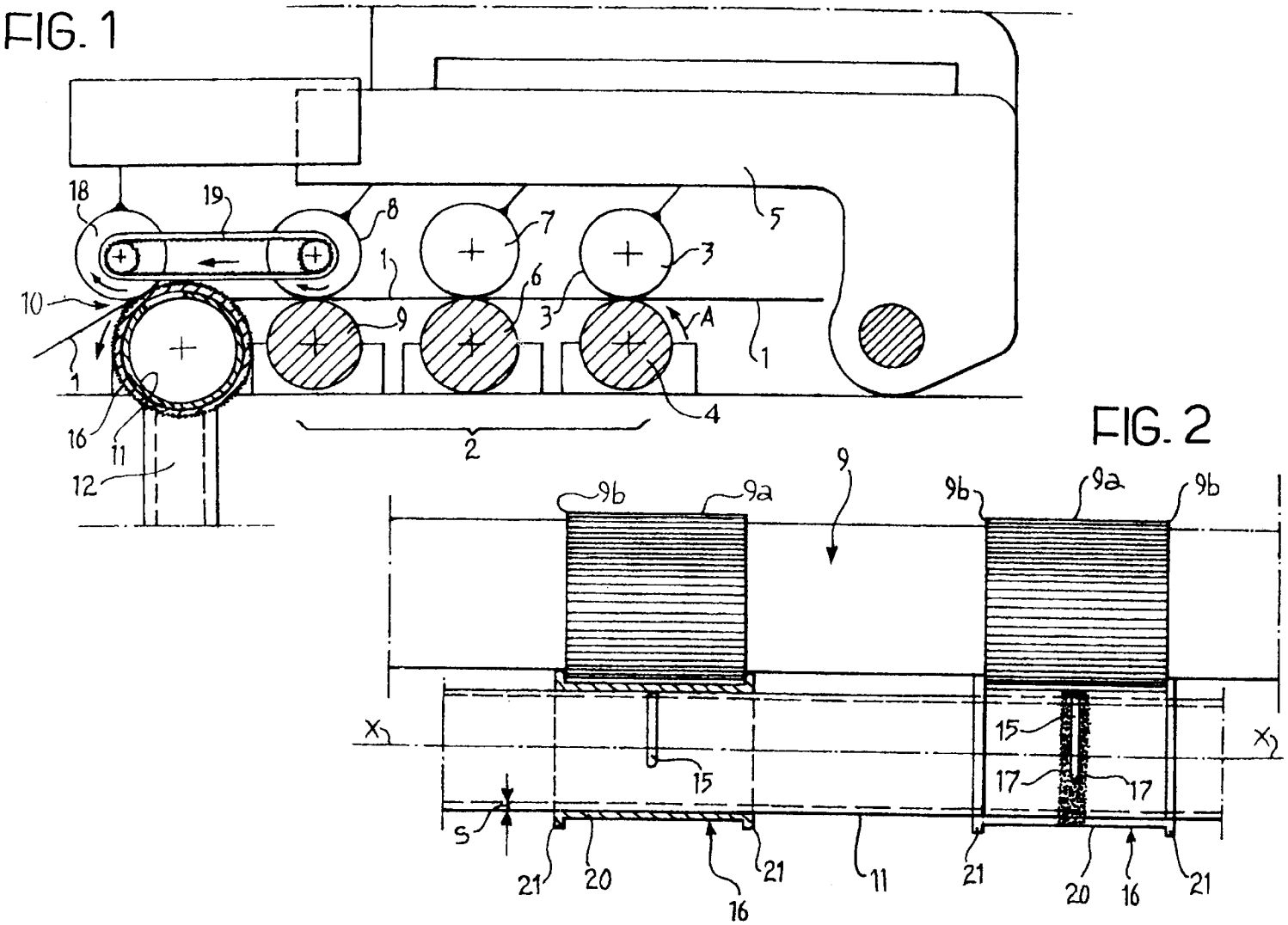
FIG. 1 is a partially-sectioned, side elevational view of a drawing unit and of a compacting unit according to the invention.
FIG. 2 is a top view showing some portions of the compacting unit in two adjacent spinning stations, on an enlarged scale and partially in section.

With reference to FIG. 1, a bundle of textile fibres or roving 1 is supplied to a drawing unit, generally indicated 2, comprising three pairs of members which draw the roving along at increasing linear velocities in order to attenuate it gradually.

In the drawing unit 2, a first pair of rollers 3, 4 takes up the roving at a controlled linear velocity. The roller 4 is rotated in accordance with the arrow A and the upper roller 3 is freely rotatable on an upper support 5 in order to be pressed against the roller 4 with the crude roving interposed between them. A second pair of rollers 6, 7, comprises a lower roller 6 rotated at a linear velocity greater than the output velocity from the first pair of rollers 3, 4, and the upper roller 7, which is freely rotatable on the support 5, is rotated by the lower roller 6. A third pair of drawing members comprises an upper, freely rotatable roller 8 pressed against a scored portion 9*a* (FIG. 2) of a lower shaft 9 driven at a linear velocity greater than that of the second pair of drawing rollers 6, 7.

The roving output by the drawing unit 2 then goes to a compacting unit 10 disposed downstream of the drawing unit before being sent for twisting.

The compacting unit 10 comprises a lower, fixed tube 11 of circular cross-section connected to a suction source (not shown) by means of a manifold 12. As shown in FIG. 2, in each station, the tube 11, which is common to several spinning stations disposed side by side, has a narrow suction slot 15 arranged on the path of the roving and along its direction of advance.

A plurality of freely rotatable cylindrical sleeves 16 are mounted along the tube 11, one in each spinning station and each having a perforated central portion 17 which extends around the entire circumference of the sleeve and covers the corresponding slot 15 with a wide margin. Each sleeve 16 is rotated about the tube 11 by a pressure roller 18 of elastomeric material which presses the roving against the perforated portion 17 of the filtering sleeve 16. The pressure roller 18 is rotated by the last pressure roller 8 of the drawing unit, by means of a belt transmission 19. It is pointed out that, in FIG. 2, the left-hand sleeve is shown in broken outline and in section in order to show the slot 15.

The rotary sleeve 16 may be made of plastics material, metal, or sintered material and are preferably made of synthetic polymeric material having good mechanical and self-lubricating properties, for example, plastics materials based on polyamides, polyaldehydes and the like, which reduce the sliding friction developed during the rotary movement around the tube 11.

Each sleeve 16 has a main, cylindrical, tubular portion 20 which comprises the perforated central portion 17 and which constitutes the region on which the pressure roller 18 is engaged. The main tubular portion 20 has a radial thickness s preferably of between 0.1 and 3 mm, to permit a correct rotational driving action by the pressure roller 18. The inside diameters of the sleeves 16 are such that the sleeves are mounted on the tube with a minimal clearance that does not hinder rotation. The overall axial width of each sleeve 16 is preferably between 5 and 15 mm, in order to reduce the area of contact with the tube 11.

An important characteristic of the invention is that the sleeves 16 have distinct regions having differentiated radial distances from their central axis x in order to cooperate with an axially stationary retaining element which holds the sleeves in the correct axial position along the tube 11 with the perforated portions 17 extending around the slots 15.

Figure 3:
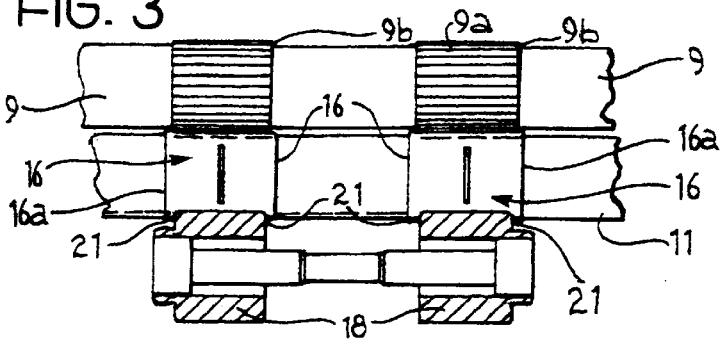
FIGS. 3 to 6 are views, similar to FIG. 2, of alternative embodiments of the invention.
Figure 4:
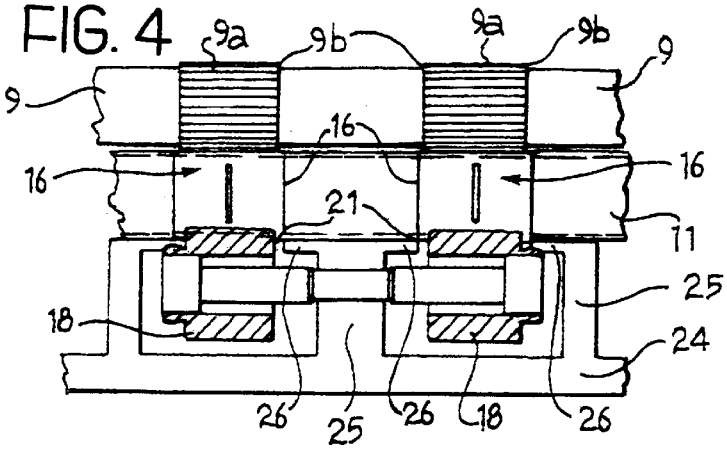

In the embodiments shown in FIGS. 2, 3 and 4, each sleeve 16 has a pair of axially spaced-apart, radial projections 21 situated in the regions of the axial ends of the sleeve and projecting radially from the tubular portion 20. The radial projections 21 are preferably in the form of annular flanges.

In the embodiment of FIG. 2, the fixed tube 11 and the shaft 9 are spaced apart in a suitable manner such that the scored portions 9*a*, which are of larger diameter than the rest of the outer surface of the shaft 9, cooperate with the end flanges 21 of the sleeve 16 in order to hold it in the correct axial position. The scored portions 9*a* thus have an axial length slightly less than the axial distance between the two flanges of the same sleeve so that the edges 9*b* of the scored portions 9*a* define radial shoulder surfaces which limit the axial movements of the sleeve along the tube 11 in both directions.

As shown in FIG. 3, the radial projections 21 of the sleeve advantageously also serve to hold in the correct axial position the respective pressure rollers 18, which bring about the rotation of the sleeves.

FIG. 4 shows an alternative embodiment in which there is a further stationary retaining element which defines the axial position of the sleeve 16 and may be used as an alternative to or, as shown in FIG. 4, in combination with the scored portions 9*a* of the shaft 9. In this embodiment, the retaining element is a spacer 25 mounted on a support 24 firmly fixed to the shaft 9 axially; the mounting of the support 24 on the shaft 9 is not shown for simplicity. The spacer 25 projects towards the tube 11 and has appendages 26 which are interposed with slight clearance between the projections 21 of two consecutive sleeves 16 in order to limit the axial movements of the sleeves along the tube 11.

Figure 5:
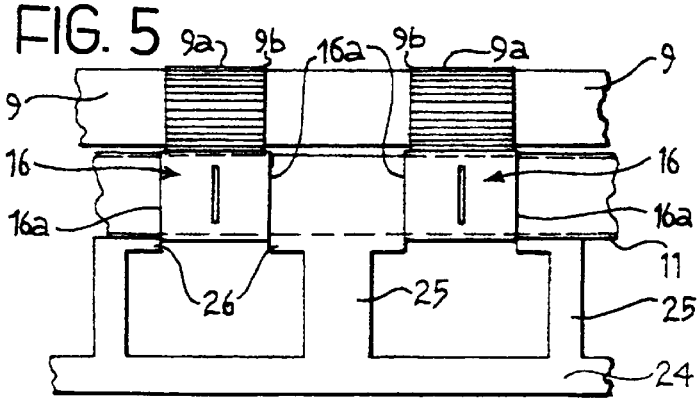

FIG. 5 shows a further variant in which the sleeves are cylindrical, tubular elements without radial projections; the correct axial positioning of the sleeves 16 is ensured in this embodiment by the appendages 26 of the spacer elements 25 which cooperate with the radial end surfaces 16*a* of the sleeves. In this embodiment, the fixed tube 11 and the shaft 9 may also be disposed farther apart than in the configuration shown in FIG. 5. as shown in FIG. 1.

Figure 6:
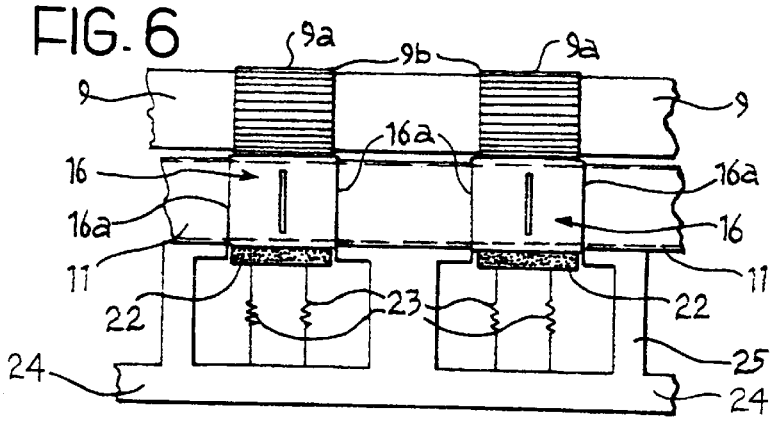

According to a further variant, shown in FIG. 6, the support 24 has a respective cleaner element 22, for example a sponge element, for each sleeve 16. The element 22 has an axial length corresponding to that of the sleeve 16 and is urged resiliently into engagement against the sleeve, for example, by means of one or more resilient elements 23 mounted on the support 24, or by making use of the resilient properties of the material constituting the cleaner element 22.

The distribution of the holes in the perforated portion 17 is preferably uniform with a density greater than 64 holes per $cm^2$, with a solid/void ratio of less than 0.4. The diameter of the holes is preferably between 0.05 and 0.7 mm.

The perforated central portion 17 constituting the filtering region of the sleeve 16 may be in the form of a mesh or fabric with threads of plastics material and/or metal, for example, in accordance with any of the configurations illustrated in the firm Haver and Boecker's catalogue "*Stainless Steel Fine Mesh Woven Wire Cloth*".

Figure 7:
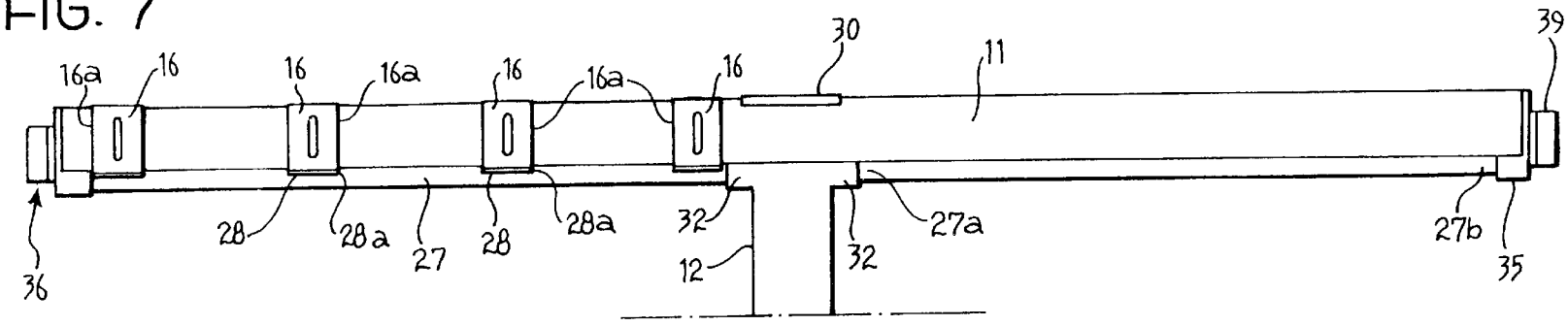
FIG. 7 is a partially-sectioned plan view of some portions of the compacting unit in several adjacent spinning stations, according to a further embodiment of the invention.

FIG. 7 shows a further alternative embodiment in which the correct axial position of the sleeve 16, which is free of radial projections, is ensured by a straight element 27 fixed adjacent the tube 11 and having recesses 28 spaced apart axially in a manner such that each recess is positioned in front of the sleeve 16 of a respective spinning station. The recesses 28 have an axial length just greater than that of the sleeves and a radial depth such as to enable the lateral ends 28*a* of the recesses to cooperate with the ends 16*a* of the sleeves in order to limit their axial movements along the tube 11. The straight element 27 may have an arcuate cross-section in order better to fit the outer cylindrical surface of the tube 11.

Figure 8:
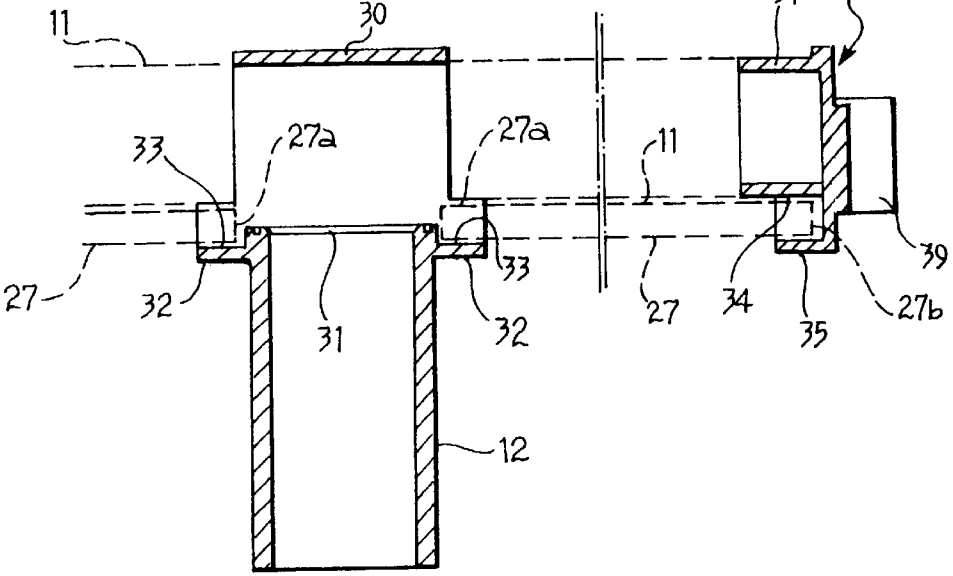
FIG. 8 is a schematic view showing some components used in the embodiment of FIG. 7, in section and on an enlarged scale.

In this embodiment, the manifold 12 has an arcuate clamping element 30 which extends around the tube 11 so as to clamp the manifold on the tube. As can be seen in FIG. 8, immediately downstream of the opening 31 which puts the manifold 12 into communication with the tube 11, the manifold has an external pair of opposed transverse projections 32 which, together with the outer surface of the tube 11, define a pair of seats 33. The seats 33 serve to clamp the ends 27*a* of a pair of straight elements 27, in the manner which will be explained below.

Also shown in FIG. 8 is a stopper-like closure element 36 comprising a cylindrical portion 37 which is fitted in the end of the tube 11 and a concave element 35 which, together with the outer surface of the tube 11, defines a seat 34 for housing an end 27*b* of a straight element 27. At the end remote from that facing the tube, the stopper-like element 36 forms and appendage 39 which extends transversely and serves for the clamping of the tube 11 at its opposite ends to a pair of fixed elements (not shown) which are fixed firmly to the spinning machine and are intended to confer stability on the tube and on the subassembly as a whole.

In order to clamp each straight element 27 adjacent the tube 11, a first end 27*a* thereof must be fitted into the seat 33 in the manifold 12 and the end of the tube 11 must then be plugged by means of the plug 36 so that the seat 34 clamps the second end 27*b* of the straight element 27.

In the embodiment shown, each sleeve 16 is formed with a corresponding axial length such as to cover a slot of a single spinning station. In an alternative embodiment, not shown, the sleeves 16 may be of a greater axial length suitable for covering the slots of two or more adjacent drawing units.

The outer surfaces of the cylindrical portions 20 of the sleeves may be rough, for example, knurled, or scored axially, to favour the transmission of the rotary motion by the roller 18. The inner surfaces of the sleeves may be suitably shaped and/or treated, for example, by forming a polished surface therein or by other means known to persons skilled in the art, in order to reduce friction with the tube 11 and so that obstacles are not encountered in the rotary movement around it.

As can be appreciated, since the axial positioning of the sleeves is entrusted to a stationary element distinct from the fixed tube 11, the latter can advantageously be made smooth and without any special machining to form the seats for the conventional locating rings mentioned in the introductory portion of the description.

What is claimed is:

1. A compacting unit for compacting a bundle of textile fibres coming from a drawing unit in a spinning station of a spinning machine, of the a comprising:

a fixed tube of circular cross-section which is common to several spinning stations disposed side by side and is connected to a suction source and which has, in each station, a suction slot arranged on a path of the bundle of fibres and along the fibres direction of advance, at least one cylindrical filtering sleeve freely rotatable on the fixed tube and having at least one perforated portion which extends around at least one corresponding slot, the sleeve being rotated about the fixed tube by a pressure roller which presses the bundle of fibres against the perforated portion of the filtering sleeve, wherein the sleeve is adapted for cooperating with at least one stationary retaining element which is separate from the tube and limits the axial movements of the sleeve along the tube.

2. The unit of claim 1, wherein the sleeve has distinct regions having differentiated radial distances from a central axis of the sleeve, the distinct regions being arranged for cooperating with at least one axially stationary retaining element which is separate from the tube and is arranged to limit the axial movements of the sleeve along the tube.

3. The unit of claim 2, wherein the distinct regions comprise at least one radial projection disposed in the region of at least one of two axial ends of the sleeve.

4. The unit of claim 3, wherein the at least one radial projection is an annular flange.

5. The unit of claim 3, wherein the sleeve has a pair of axially spaced-apart, radial projections and in that the retaining element can be engaged between the pair of radial projections.

6. The unit of claim 5, wherein the axially spaced-apart, radial projections are situated in the regions of the axial ends of the sleeve.

7. The unit of claim 5, wherein the retaining element is constituted by a portion of enlarged diameter of a rotary shaft forming part of the drawing unit associated with the compacting unit.

8. The unit of claim 5, wherein the pressure roller is engaged and retained axially between the pair of radial projections.

9. The unit of claim 1, wherein the retaining element is mounted on a fixed support.

10. The unit of claim 9, wherein the support carries, for each sleeve, a cleaning element urged resiliently into engagement against the sleeve.

11. The unit of claim 1, wherein the retaining element is mounted on a support fixed axially to a shaft.

12. The unit of claim 1, wherein the axially stationary retaining element comprises a spacer element with axially opposed appendages for cooperating with radial end surfaces of the sleeves.

13. The unit of claim 12, wherein the sleeves are cylindrical, tubular elements.

14. The unit of claim 1, wherein the sleeve has an axial length suitable for extending around the slots of two or more adjacent spinning stations.

15. The unit of claim 1, wherein the retaining element is provided on a straight element clamped adjacent the tube and having, in the region of each spinning station, a pair of substantially radial and axially spaced-apart surfaces for cooperating with the ends of each sleeve.

16. The unit of claim 15, wherein the straight element can be clamped, at a first of its ends, in a first seat formed by a suction manifold disposed in the region of an intake opening formed in the tube and, at a second of its ends, in a second seat formed by a closure element disposed at an end of the tube.

17. The unit of claim 1, wherein the sleeve comprises a cylindrical portion which includes the perforated portion and has a rough outer surface for promoting the transmission of the rotary motion by the pressure roller.

18. The unit of claim 1, wherein the fixed tube has a smooth outer cylindrical surface.

19. The unit of claim 1, wherein distribution of the holes in the perforated portion is uniform with a density greater than 64 holes per $cm^2$ and a solid/void ratio of less than 0.4.

20. The unit of claim 1, wherein holes of the perforated portion have diameters of between 0.05 and 0.7 mm.

21. The unit of claim 1, wherein the sleeve comprises a main cylindrical portion which includes the perforated portion and which has a radial thickness (s) of between 0.1 and 3 mm.

22. The unit of claim 1, wherein each sleeve has overall axial dimension of between 5 and 15 mm.

* * * * *